US006779374B1

(12) United States Patent
Roldan

(10) Patent No.: US 6,779,374 B1
(45) Date of Patent: Aug. 24, 2004

(54) SYSTEM AND METHOD FOR BULGE FORMING A BLANK INTO AN ARTICLE INCLUDING SHAPED PORTIONS

(75) Inventor: Gerardo Roldan, Temple City, CA (US)

(73) Assignee: Klune Industries, Inc., North Hollywood, CA (US)

( * ) Notice: Subject to any disclaimer, the term of this patent is extended or adjusted under 35 U.S.C. 154(b) by 239 days.

(21) Appl. No.: 09/660,985

(22) Filed: Sep. 13, 2000

(51) Int. Cl.[7] ..... B21D 22/12
(52) U.S. Cl. ..... 72/60; 72/56; 29/421.1
(58) Field of Search ..... 72/56, 61, 63, 72/60; 29/421.1

(56) References Cited

U.S. PATENT DOCUMENTS

| | | | | | |
|---|---|---|---|---|---|
| 1,329,969 | A | * | 2/1920 | Harrison | 72/63 |
| 2,348,921 | A | * | 5/1944 | Pavlecka | 72/63 |
| 2,375,599 | A | * | 5/1945 | Walton | 72/63 |
| 2,385,083 | A | * | 9/1945 | Kemerer | 72/63 |
| 3,526,116 | A | * | 9/1970 | Landa et al. | 72/63 |
| 3,531,966 | A | * | 10/1970 | Pappas | 72/63 |
| 3,670,546 | A | * | 6/1972 | De La Sierra | 72/63 |
| 3,739,617 | A | * | 6/1973 | Stejskal | 72/63 |
| 4,765,166 | A | * | 8/1988 | Bergman et al. | 72/63 |

FOREIGN PATENT DOCUMENTS

| | | | | |
|---|---|---|---|---|
| DE | 1279608 | * | 10/1968 | 72/63 |
| IT | 463541 | * | 10/1951 | 72/63 |
| SU | 437628 | * | 7/1974 | 72/63 |

* cited by examiner

*Primary Examiner*—David B. Jones
(74) *Attorney, Agent, or Firm*—Fulwider Patton Lee & Utecht, LLP

(57) ABSTRACT

In a system and method for bulge forming an article including a shaped portion from blank stock, the system includes a cage section adapted to enable the blank stock to be positioned and enclosed therein, and a die element, for enabling the shaped portions of the article to be formed thereagainst, adapted to be enclosed in the cage sections. The system further includes a flexible member, adapted to be enclosed in the cage sections, and to bulge therein upon the application of pressure to the flexible member. The flexible member is also adapted to push into and exert pressure on the blank, and to bend the blank relative to the die element to form the shaped portion of the article. The system also includes a flexible tube, for enabling expansion of the flexible member upon pumping a pressure exerting medium therethrough into the flexible member, to exert pressure on the blank and form the shaped portion of the article against the die element.

79 Claims, 5 Drawing Sheets

SYSTEM AND METHOD FOR BULGE FORMING A BLANK INTO AN ARTICLE INCLUDING SHAPED PORTIONS

BACKGROUND OF THE INVENTION

1. Field of the Invention

This invention relates generally to improvements in forming articles from blank stock and, more particularly, to a new and improved system and method for bulge forming a substantially flat blank into an article which comprises a formed part, and which includes a shaped portion.

2. Description of the Related Art

It has been known to form an article such as a metal article including a shaped portion from blank metal stock through various processes such as roll forming, stretch forming, spinning, or hydroforming, augmented by straightening, repeated inspections, and finishing operations.

However, such metal forming processes require a number of forming operations, resulting in variations in metal thickness, residuals, induced stress, inconsistency, and relatively low article integrity, and further requiring extensive finishing operations to form a finished part. These problems are particularly prevalent in the metal forming of very large, lightweight, structural modules, such as for aircraft structures.

Therefore, those concerned with the development and use of improved metal forming systems and methods and the like have recognized the need for improved systems and methods for forming a substantially flat sheet metal blank, of any size, shape, and thickness, into an article which comprises a finished formed part, and which includes a shaped portion or a plurality of shaped portions, in an efficient and effective manner. The need has further been recognized for such systems and methods which prevent thickness variations and scratches, improve finished part integrity and consistency, reduce the number of process operations, and prevent induced stress. The need for such effective and efficient metal forming has been particularly recognized for processes for the metal forming of large, thin-walled, lightweight, complex-shaped, structural, finished parts, for industries such as the aircraft and defense industries.

Accordingly, the present invention fulfills these needs by providing efficient and effective systems and methods for metal forming a sheet metal blank into an article of any size, shape, and thickness which includes a shaped portions, while providing improved article thickness uniformity, integrity and consistency, with a reduced number of operations, and which greatly reduces induced stress.

SUMMARY OF THE INVENTION

Briefly, and in general terms, the present invention provides a new and improved system and method for bulge forming an article from blank stock, in an effective and efficient manner.

By way of example, and not by way of limitation, the present invention provides a new and improved system for bulge forming a substantially flat blank into an article which comprises a formed part and which includes shaped portions.

More particularly, the bulge forming system of the present invention may include a form-shaping element, for enabling the shaped portions of the article to be formed thereagainst. It includes a portion complementary in shape to the shape of the shaped portion of the article to be formed thereby. It may further include an enclosure enabling element for enabling the form-shaping element to be enclosed therein, and for enabling the blank to be positioned and enclosed therein.

The system, in accordance with the present invention, may further include a flexible member, adapted to be enclosed within the enclosing enabling element, and adapted to bulge within the enclosing enabling element upon the application of pressure to the flexible member. The flexible member may also be adapted to exert pressure by pushing on the blank adapted to be positioned in the enclosing enabling element, and to bend the blank relative to the form shaping element complementary portion to form the shaped portion of the article. The system may also include an expansion enabling element for enabling expansion of the flexible member, upon pumping a pressure exerting medium therethrough into the flexible member, so as to exert pressure on the blank and form the shaped portion of the article against the form-shaping element.

Therefore an advantage of the present invention is that it includes an improved system and method for effectively and efficiently bulge forming substantially flat blank stock into an article which may comprise a formed finished part, which includes a shaped portion, or a complex part which includes a plurality of shaped portions.

A further advantage is that the present invention provides the bulge forming of a formed finished part of any size, shape, and thickness which reduces the number of process steps, reduces induced stress and scratches in the article, and improves the thickness uniformity, integrity and consistency of the finished part.

These and other objects and advantages of the invention will become apparent from the following more detailed description, when taken in conjunction with the accompanying drawings of illustrative embodiments.

DETAILED DESCRIPTION OF THE PREFERRED EMBODIMENTS

Figure 1:
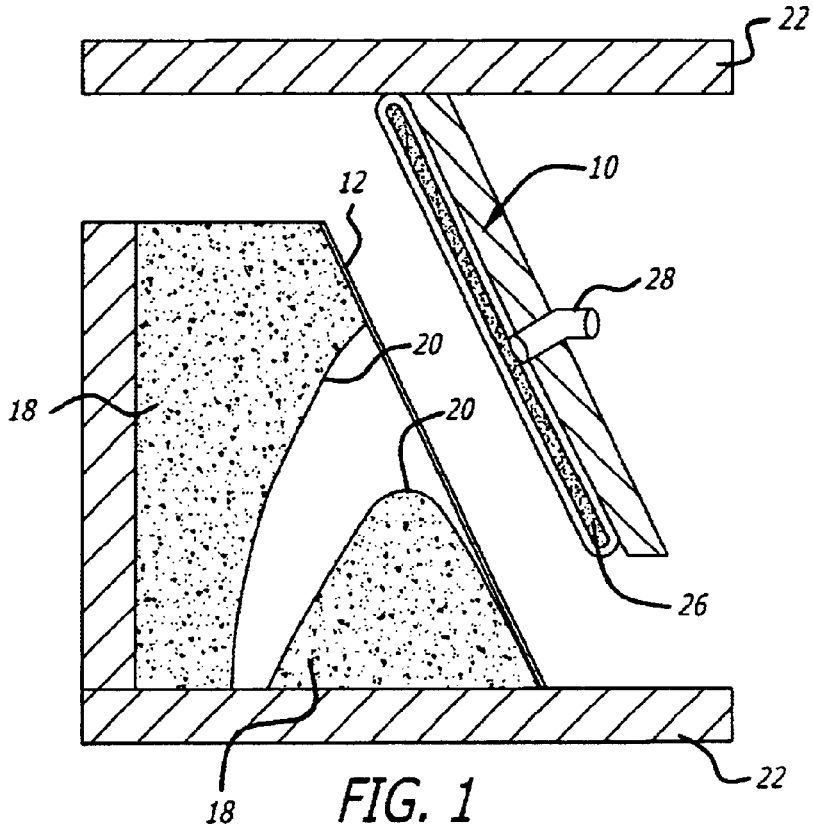
FIG. 1 is an elevational cross-sectional view of a bulge forming system, with the cage sections opened and separated in a first embodiment in accordance with the present invention.

The present invention is directed to an improved system and method for forming an article from blank stock. The improved system and method provides efficient and effective elements for shaping portions of the article to be formed thereby. The preferred embodiments of the improved system and method are illustrated and described herein by way of example only and not by way of limitation.

Referring now to the drawings, wherein like reference numerals denote like or corresponding parts throughout the drawing figures, and particularly to FIGS. 1–7, a system 10 is provided for bulge forming a substantially flat blank 12 into an article 14 which includes a shaped portion 16. The article 14 may be complex in shape, and may be bulge formed from the blank 12 to include a plurality of shaped portions 16. The blank 12 may be comprised of a lightweight material such as a sheet metal, as for example aluminum. The article 14 in which the shaped portion 16 is to be bulge formed may comprise a formed part which may be finished. It may comprise an article 14 of any size, shape, and thickness, which may be substantially large thin-walled, lightweight, and complex in shape, and which may comprise a structural module, such as, for example, an aircraft fuselage crown frame, which comprises a fuselage frame structural rib for attachment of other aircraft parts thereto. The blank 12 to be formed into the article 14 may be correspondingly substantially large. The thickness of the article 14 to be formed thereby, for example, may be in the range of between fifteen and one-hundred-sixty thousandths of an inch.

The system 10 also includes a die element 18 for enabling the shaped portions 16 of the article 14 to be formed thereagainst. The die element 18 includes portions 20 complementary in shape to the shape of the shaped portion 16 of the article 14 to be formed thereby. The system 10 further includes a plurality of inter-engageable cage sections 22, adapted to be secured together to enable the shaped portion 16 of the article 14 to be formed thereby. The cage sections 22 are further adapted to be separated to enable the blank 12 to be inserted therein, and to enable removal of the article 14 formed therein. The cage sections 22, upon being secured together, include hollow portions 24 formed therein.

The system 10 further includes a flexible member 26, adapted to be enclosed within the cage sections 22, and to bulge within the cage sections 22 upon the application of pressure to the flexible member 26. The flexible member 26 is further adapted to exert pressure by pushing on the blank 12 adapted to be positioned in the cage sections 22, and to bend the sheet metal 12 relative to the complementary shaped portions 20 of the die element 18 to form the shaped portion 16 of the article 14. The flexible member 26, for example, may comprise a bladder, and may be comprised of a material such as rubber or polyurethane. The pressure to be exerted by the flexible member 26 may, for example, be between 400 and 4000 pounds per square inch. The cage sections 22, the die element 18, and the flexible member 26 may be substantially large elements corresponding to the substantially large article 14 to be formed thereby.

Figure 3:
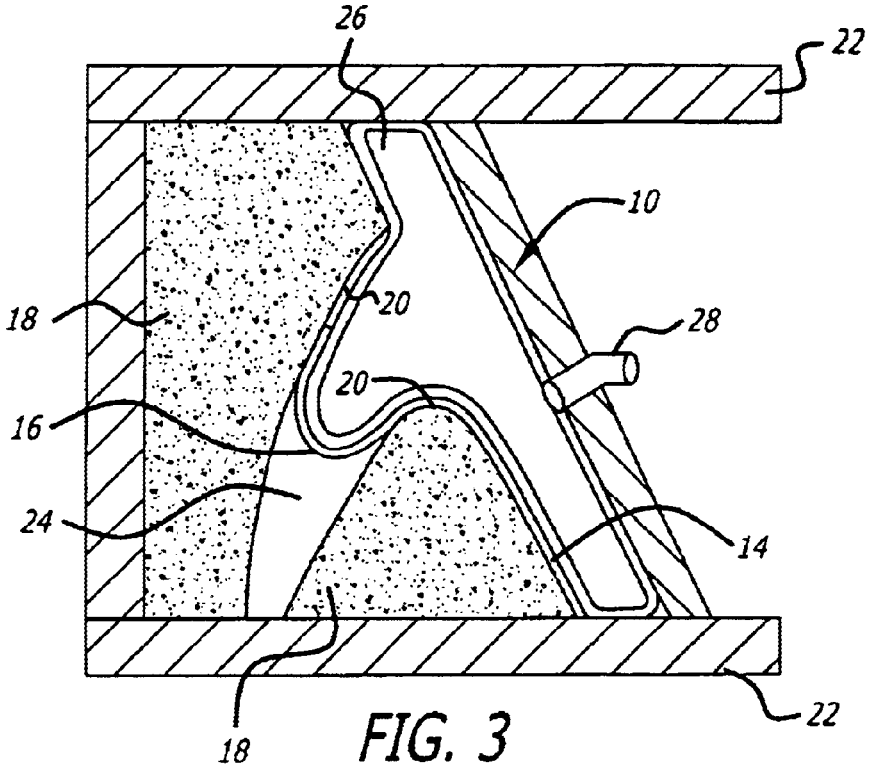
FIG. 3 is a similar view of the bulge forming system, with the flexible member expanded therein, in the first embodiment of the invention.
Figure 4:
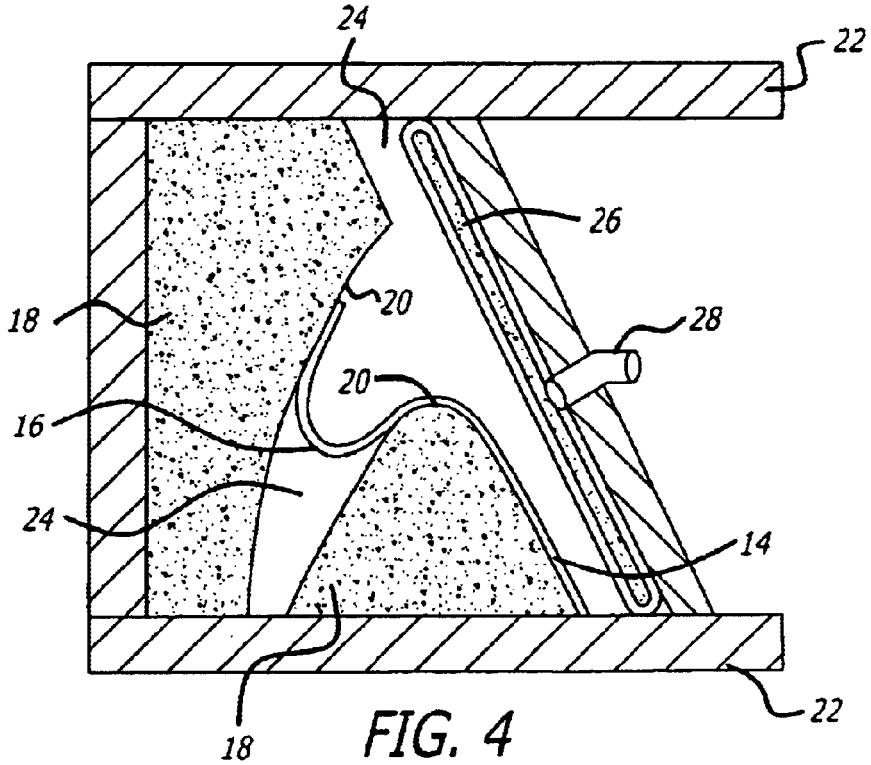
FIG. 4 is a similar view of the bulge forming system, with the flexible member contracted therein, in the first embodiment of the invention.
Figure 5:
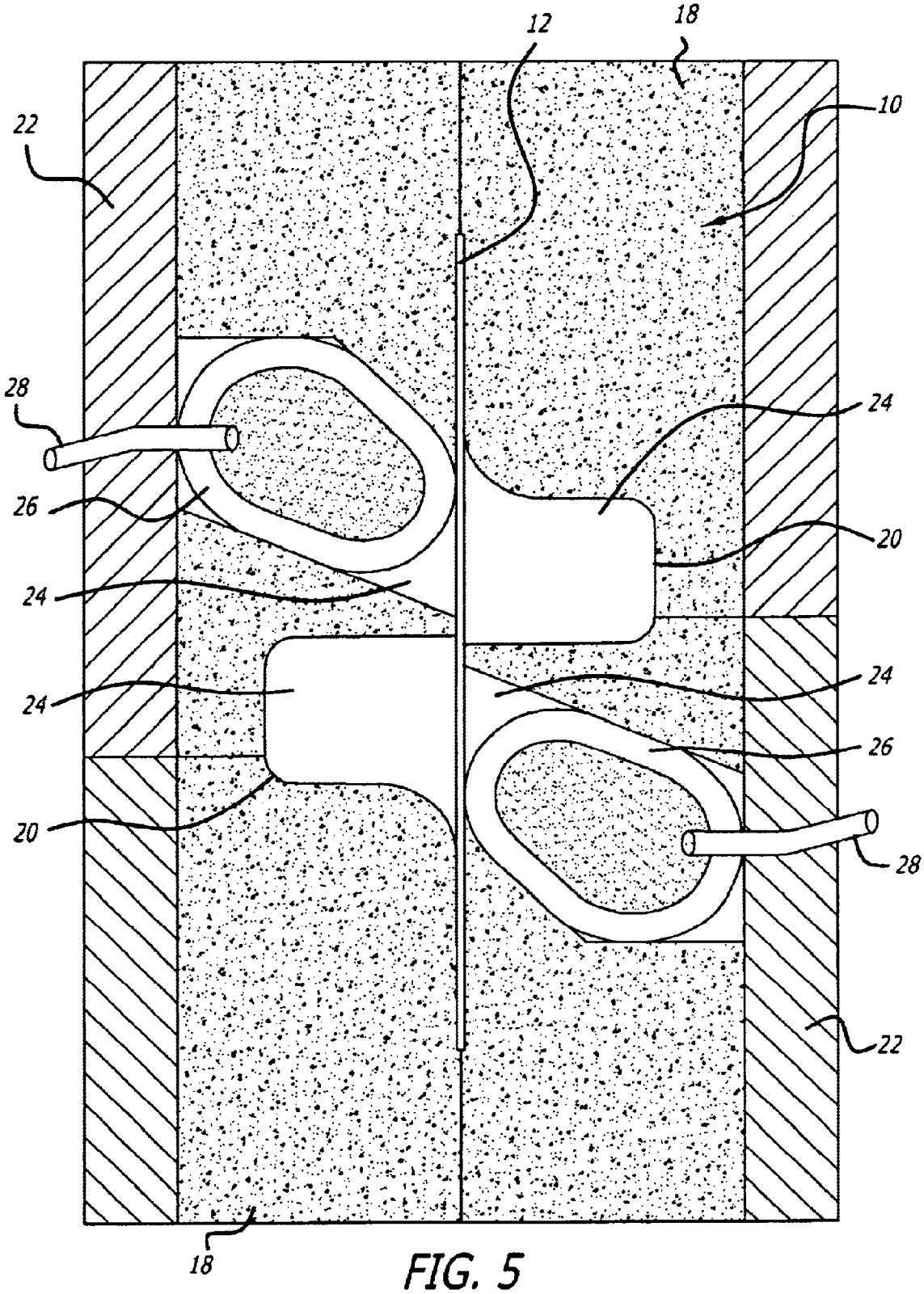
FIG. 5 is an elevational cross-sectional view of a bulge-forming system, with the cage sections closed and engaged together, in a second embodiment of the invention.
Figure 6:
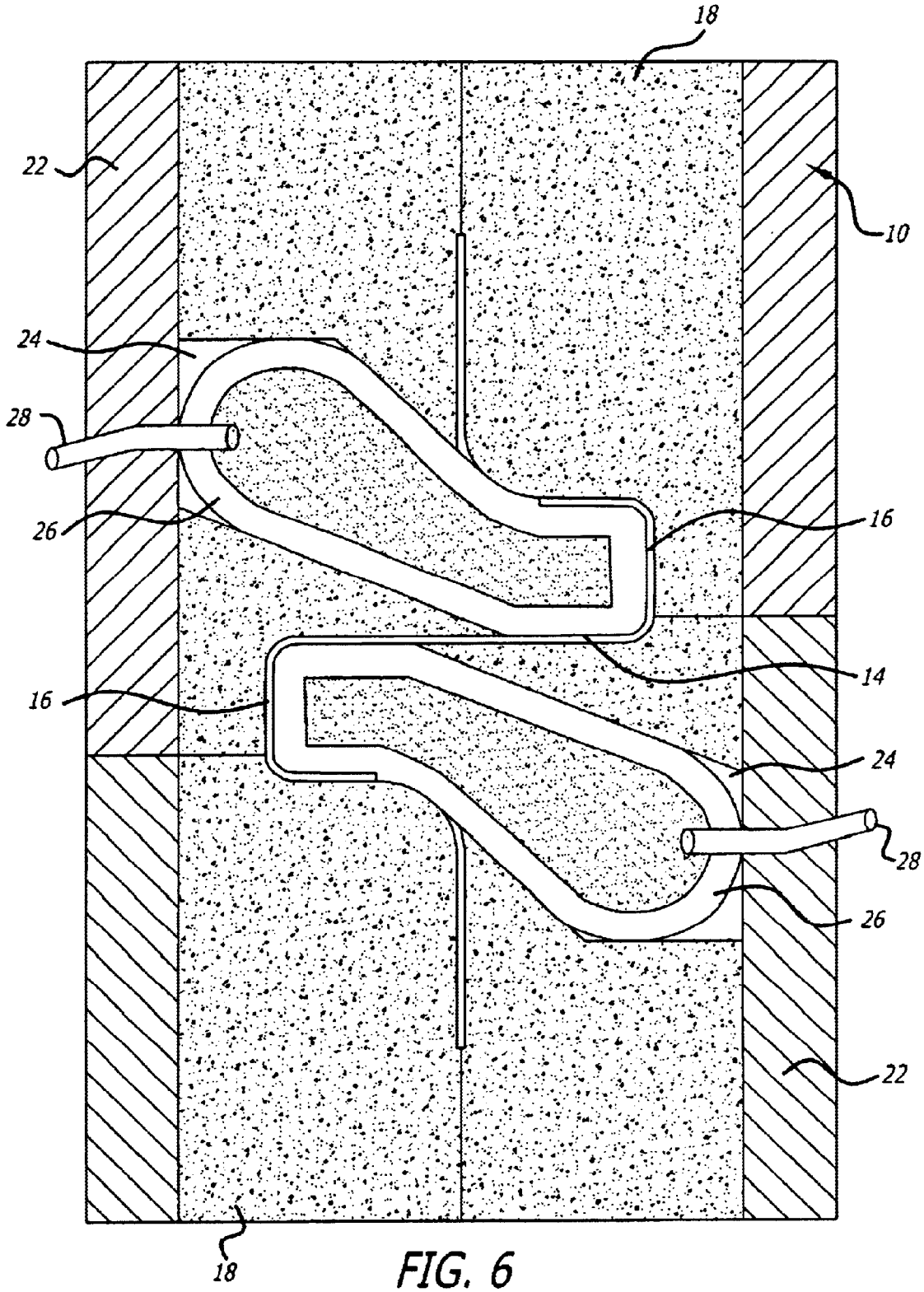
FIG. 6 is a similar view of the bulge forming system, with the flexible members expanded therein, in the second embodiment of the invention.
Figure 7:
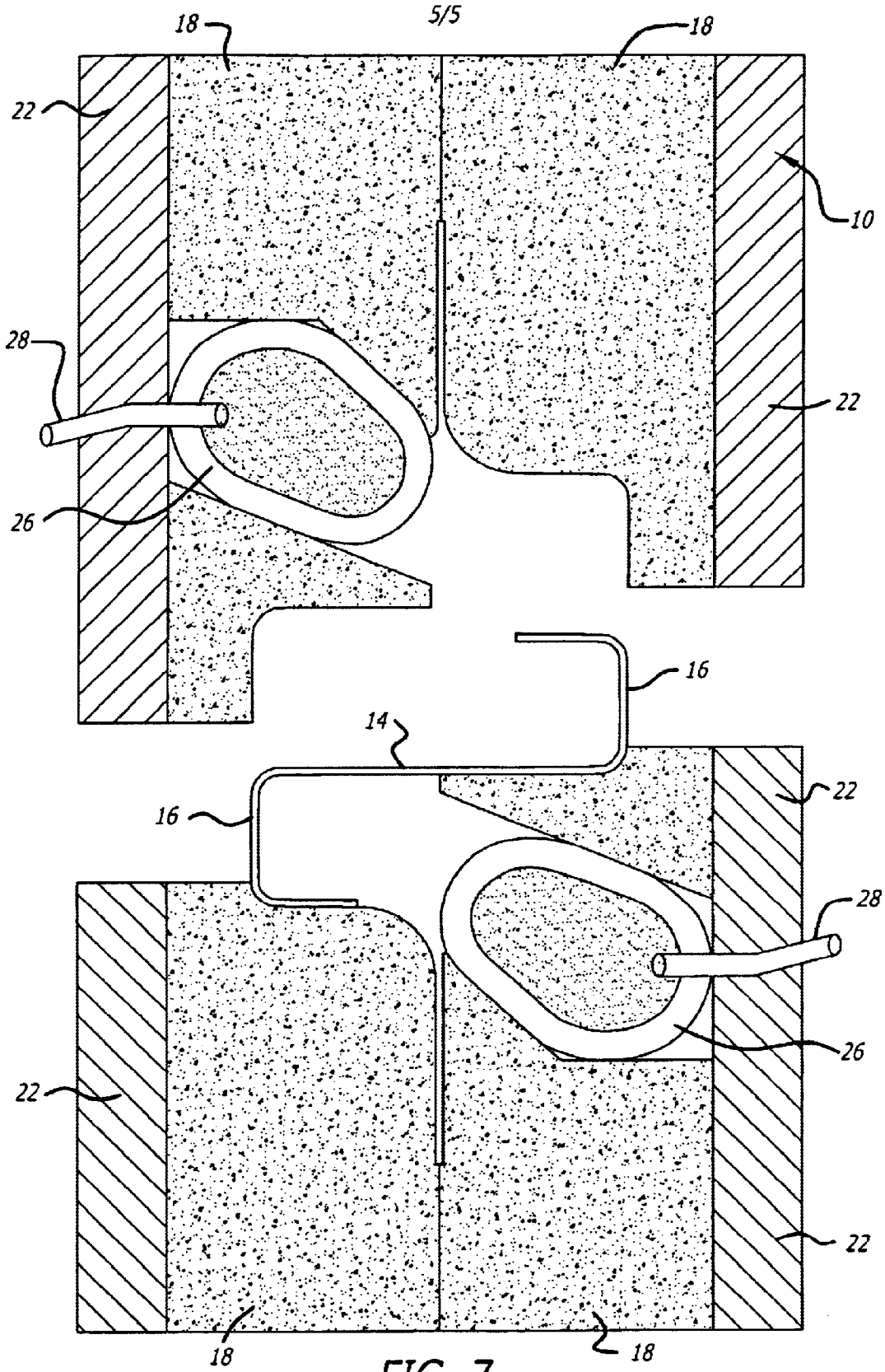
FIG. 7 is a similar view of the bulge forming system, with the cage sections opened and separated, in the second embodiment of the invention.

The flexible member 26 may be attached to cage section 22 as shown in FIGS. 1–4, or alternatively, may be moveable in the cage sections 22, as illustrated in FIGS. 5–7. For bulge forming a complex shaped article 14 which may include a plurality of shaped portions 16, with a plurality of different radii, the system 10 may, for example, include a plurality of flexible members 26, as seen in FIGS. 5–7. The plurality of flexible members 26 may be attached to a cage section 22, or alternatively, as shown in FIGS. 5–7, may be movable in the cage sections 22.

The system 10 may further include an element 28 for enabling expansion of the flexible member 26 so as to exert pressure on the sheet metal 12 and form the shaped portions 16 of the article 14 against the die element 18. The expansion enabling element 28 may comprise a tube, which may be flexible, adapted to be connected to the flexible member 26. The tube 28 may further be adapted to enable a medium for exerting pressure in the flexible member 26 to be pumped therethrough into the flexible member 26, for expansion of the flexible member 26. The pressure-exerting medium may for example comprise hydraulic fluid.

Figure 2:
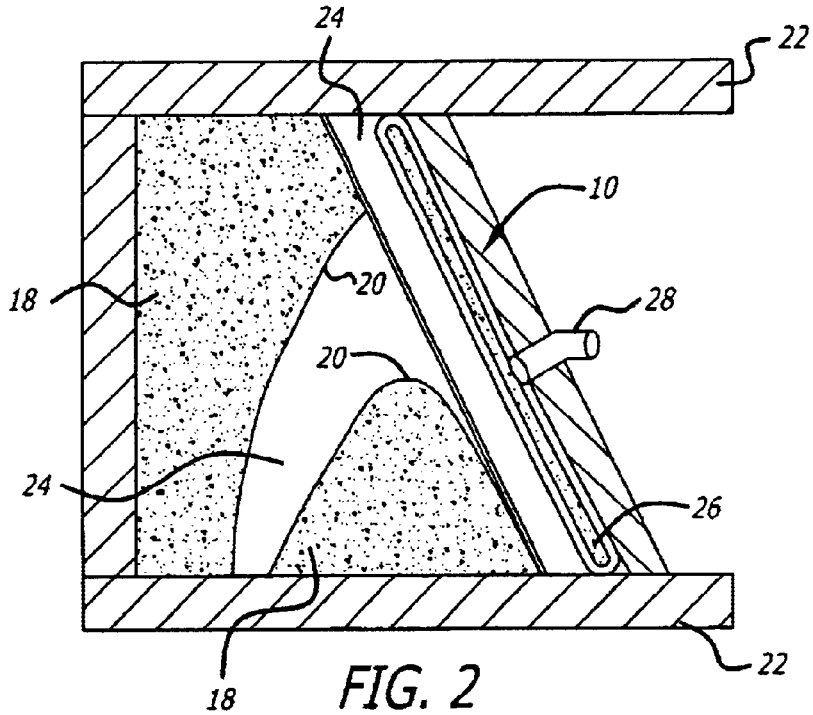
FIG. 2 is a similar view of the bulge forming system, with the cage sections closed and engaged together, in the first embodiment of the invention.

In the operation of the system 10, as shown in FIGS. 1–4, and in particular in FIG. 1, the blank 12 may have been formed from a coil by cutting, heat treating, stretching, and trimming thereof, the cage sections 22 may be opened and separated, and the substantially flat blank 12 may be positioned across the die element 18. As seen in FIG. 2, the cage sections 22 may then be closed and engaged together, enclosing the blank 12 therein. As illustrated in FIG. 3, oil may have been applied to the exterior of the flexible member 26, and the attached flexible member 26 may then be expanded, through introduction thereinto of a pressure exerting medium, such as by pumping hydraulic fluid through the tube 28. The flexible member 26 may then exert pressure by pushing on the blank 12 against the shaped portions 20 of the die element 18, to form the shaped portion 16 of the article 14 and to generate a uniform thickness thereof. The pressure exerted by the flexible member 26 enables the portion 16 of the blank 12 which is to be shaped thereby to move rapidly into the hollow portion 24 of the die element 18, compressing the portion 16 of the blank 12 so as to generate a uniform thickness thereof consistent with the uniform thickness of the other portions of the article 14 formed thereby. As shown in FIG. 4, the attached flexible member 26 may then be contracted through removal therefrom of the pressure exerting medium through the tube 28, so as to release the pressure exerted on the blank 12, leaving the article 14 with the shaped portion 16 therein to be removed upon opening the cage sections 22.

In an alternative embodiment of the invention, as illustrated in FIGS. 5–7, and as seen in particular in FIG. 5, the cage sections 22, which may have been opened and separated, and wherein a substantially flat blank 12 may have been positioned across a plurality of die elements 18 therein, may be closed and engaged together, enclosing the blank 12 therein. As shown in FIG. 6, the movable plurality of flexible members 26 may then be expanded, through introduction of a pressure exerting medium thereinto, such as by pumping hydraulic fluid through the tubes 28, so as to exert pressure on the blank 12 against the shaped portions 20 of the die elements 18, and forming the shaped portions 16 of the article 14. As illustrated in FIG. 7, the movable flexible members 26 may then be contracted upon removal therefrom of the pressure exerting medium through each tube 28, thereby releasing the pressure exerted on the blank 12, leaving the article 14 with the shaped portions 16 thereon. The cage sections 22 may be opened and separated to enable removal of the article 14.

The present invention provides improved systems and methods for bulge forming a substantially flat blank into an article which includes a shaped portion.

In accordance with the present invention, the improved systems and methods include a system 10 for enabling a finished article 14 of any size, shape, and thickness to be formed with improved thickness uniformity, integrity and consistency, and which prevents induced stress and scratches, and in an efficient and effective manner, with a reduced number of operations. The system 10 is adapted to bulge form substantially large articles, which may for example be thin-walled, lightweight, complex shaped structural modules such as aircraft fuselage crown frames, from blanks which may be comprised, for example, of sheet metal such as aluminum.

It will be apparent from the foregoing that, while particular forms of the invention have been illustrated and described, various modifications can be made without departing from the spirit and scope of the invention. Accordingly, it is not intended that the invention be limited, except as by the appended claims.

What is claimed is:

1. A system for bulge forming an unheated substantially flat blank which includes peripheral portions, by deforming the flat blank into an article which comprises a formed part, wherein the formed part includes a shaped portion, comprising:

a deforming-enabling element for enabling deforming of the unheated blank so as to enable the shaped portions of the article to be formed thereagainst, including a complementary portion which is complementary in shape to the shape of the shaped portion of the article to be formed thereby;

an enclosing enabling element for enabling the deforming-enabling element to be enclosed therein, and for enabling the unheated blank to be positioned and enclosed therein without restricting deforming of the flat blank including the peripheral portions thereof;

a flexible member, adapted to be enclosed within the enclosing enabling element, to bulge within the enclosing enabling element upon the application of pressure to the flexible member, to exert pressure on the unheated blank adapted to be positioned in the enclosing enabling element, and to deform the unheated blank relative to the form-shaping element complementary portion to form the shaped portion of the article; and an expansion enabling element for enabling expansion of the flexible member so as to exert pressure on the unheated blank and deform the unheated blank to form the shaped portion of the article against the deforming-enabling element.

2. The system of claim 1, wherein the flexible member is further adapted to be attached within the enclosing enabling element.

3. The system of claim 1, wherein the flexible member is further adapted to be movable within the enclosing enabling element.

4. The system of claim 1, wherein the flexible member comprises a bladder.

5. The system of claim 1, wherein the form-shaping element comprises a die element.

6. The system of claim 1, wherein the enclosing enabling element comprises a plurality of inter-engagable cage sections, adapted to be secured together without clamping the peripheral portions of the unheated blank therebetween to enable the article shaped portion to be formed therein, and to be separated to enable the unheated blank to be inserted therein or to enable removal of the article formed therein.

7. The system of claim 1, wherein the expansion enabling element comprises a pumping enabling element for enabling a medium for exerting pressure on the flexible member to be pumped therethrough into the flexible member for expansion of the flexible member.

8. The system of claim 1, wherein the unheated blank is comprised of sheet metal.

9. The system of claim 1, further comprising a plurality of form-shaping elements, and a plurality of flexible members.

10. The system of claim 1, wherein the article in which a shaped portion is to be bulge formed comprises a substantially large article.

11. The system of claim 1, wherein the article further comprises a finished part.

12. The system of claim 1, wherein the article is comprised of lightweight material.

13. The system of claim 1, wherein the article comprises a complex shaped article, which includes a plurality of shaped portions.

14. The system of claim 4, wherein the bladder is comprised of rubber.

15. The system of claim 4, wherein the bladder is comprised of polyurethane.

16. The system of claim 7, wherein the pumping enabling element includes a tube, adapted to be connected to the flexible member.

17. The system of claim 7, wherein the pressure-exerting medium comprises hydraulic fluid.

18. The system of claim 8, wherein the unheated sheet metal blank is comprised of aluminum.

19. The system of claim 10, wherein the article comprises an aircraft fuselage crown frame.

20. The system of claim 10, wherein the article to be formed thereby further comprises a thin-walled article.

21. The system of claim 10, wherein the article to be formed thereby further comprises a structural article.

22. The system of claim 10, wherein the unheated blank to be formed into the article is substantially large corresponding to the substantially large article.

23. The system of claim 10, wherein the enclosing enabling element, the form shaping element, and the flexible member are substantially large corresponding to the substantially large article.

24. The system of claim 16, wherein the tube comprises a flexible tube.

25. The system of claim 7, wherein the pressure exerting medium is adapted to exert substantially high pressure.

26. A system for bulge forming an unheated substantially flat blank which includes peripheral portions, by deforming the flat blank into an article which comprises a formed part, wherein the formed part includes a shaped portion, comprising:

deforming-enabling means for enabling deforming of the unheated blank so as to enable the shaped portions of the article to be formed there against, including a complementary portion which is complementary in shape to the shape of the shaped portion of the article to be formed thereby;

enclosing enabling means for enabling the deforming-enabling means to be enclosed therein, and for enabling the unheated blank to be positioned and enclosed therein without restricting deforming of the flat blank including the peripheral portions thereof;

a flexible member, adapted to be enclosed within the enclosing enabling means, to bulge within the enclosing enabling means upon the application of pressure to the flexible member, to exert pressure on the unheated blank adapted to be positioned in the enclosing enabling means, and to deform the unheated blank relative to the deforming-enabling means complementary portion to form the shaped portion of the article; and expansion enabling means for enabling expansion of the flexible member so as to exert pressure on the unheated blank and deform the unheated blank to form the shaped portion of the article against the deforming-enabling means.

27. The system of claim 26, wherein the flexible member is further adapted to be attached within the enclosing enabling means.

28. The system of claim 26, wherein the flexible member is further adapted to be movable within the enclosing enabling means.

29. The system of claim 26, wherein the flexible member comprises a bladder.

30. The system of claim 26, wherein the form-shaping element comprises a die element.

31. The system of claim 26, wherein the enclosing enabling means comprise a plurality of inter-engagable cage sections, adapted to be secured together without clamping the peripheral portions of the unheated blank therebetween to enable the article shaped portion to be formed therein, and to be separated to enable the unheated blank to be inserted therein or to enable removal of the article formed therein.

32. The system of claim 26, wherein the expansion enabling means comprise pumping enabling means for enabling a medium for exerting pressure on the flexible member to be pumped therethrough into the flexible member for expansion of the flexible member.

33. The system of claim 26, wherein the unheated blank is comprised of sheet metal.

34. The system of claim 26, further comprising a plurality of form-shaping elements, and a plurality of flexible members.

35. The system of claim 26, wherein the article in which a shaped portion is to be bulge formed comprises a substantially large article.

36. The system of claim 26, wherein the article further comprises a finished part.

37. The system of claim 26, wherein the article is comprised of lightweight material.

38. The system of claim 26, wherein the article comprises a complex shaped article, which includes a plurality of shaped portions.

39. The system of claim 29, wherein the bladder is comprised of rubber.

40. The system of claim 29, wherein the bladder is comprised of polyurethane.

41. The system of claim 32, wherein the pumping enabling means include a tube, adapted to be connected to the flexible member.

42. The system of claim 32, wherein the pressure-exerting medium comprises hydraulic fluid.

43. The system of claim 33, wherein the sheet metal unheated blank is comprised of aluminum.

44. The system of claim 35, wherein the article comprises an aircraft fuselage crown frame.

45. The system of claim 35, wherein the article to be formed thereby further comprises a thin-walled article.

46. The system of claim 35, wherein the article to be formed thereby further comprises a structural article.

47. The system of claim 35, wherein the unheated blank to be formed into the article is substantially large corresponding to the substantially large article.

48. The system of claim 35, wherein the enclosing enabling means, the form-shaping element, and the flexible member are substantially large corresponding to the substantially large article.

49. The system of claim 41, wherein the tube comprises a flexible tube.

50. A method of bulge forming an unheated substantially flat blank which includes peripheral portions, by deforming the flat blank into an article which comprises a formed part, wherein the formed part includes a shaped portion, in a system which comprises a deforming-enabling element for enabling deforming of the unheated blank so as to enable the shaped portions of the article to be formed thereagainst, including a complementary portion which is complementary in shape to the shape of the shaped portion of the article to be formed thereby, an enclosing enabling element for enabling the deforming-enabling element to be enclosed therein, and for enabling the unheated blank to be positioned and enclosed therein without restricting deforming of the flat blank including the peripheral portions thereof, a flexible member, adapted to be enclosed within the enclosing enabling element, to bulge within the enclosing enabling element upon the application of pressure to the flexible member, to exert pressure on the unheated blank adapted to be positioned in the enclosing enabling element, and to deform the unheated blank relative to the form-shaping element complementary portions to form the shaped portion of the article, and an expansion enabling element for enabling expansion of the flexible member so as to exert pressure on the unheated blank and deform the unheated blank to form the shaped portion of the article against the deforming-enabling element, wherein the method comprises:

opening the enclosing enabling element and positioning the unheated blank therein relative to the form-shaping element;

closing the enclosing enabling element without restricting deforming of the flat blank including the peripheral portions thereof; and expanding the flexible member such that the flexible member bulges relative to the unheated blank and exerts pressure on the unheated blank against the deforming-enabling element so as to deform the unheated blank to form the shaped portion of the article.

51. The method of claim 50, wherein the flexible member is further adapted to be attached within the enclosing enabling element, and wherein expanding comprises exerting pressure from the attached flexible member within the enclosing enabling element.

52. The method of claim 50, wherein the flexible member is further adapted to be movable within the enclosing enabling element, and wherein expanding comprises exerting pressure from the moveable flexible member within the enclosing enabling element.

53. The method of claim 50, wherein the flexible member comprises a bladder, and wherein expanding comprises expanding the bladder.

54. The method of claim 50, wherein the form-shaping element comprises a die element, and wherein expanding comprises expanding the flexible member against the die element.

55. The method of claim 50, wherein the enclosing enabling element comprises a plurality of inter-engagable cage sections, adapted to be secured together without clamping the peripheral portions of the unheated blank therebetween to enable the article shaped portion to be formed therein, and to be separated to enable the unheated blank to be inserted therein or to enable removal formed therein, and wherein closing the enclosing enabling element comprises engaging together the sections of the enclosing enabling element without clamping the peripheral portions of the unheated blank therebetween.

56. The method of claim 50, wherein the expansion enabling element comprises a pumping enabling element for enabling a medium for exerting pressure in the flexible member to be pumped therethrough into the flexible member for expansion of the flexible member, and wherein expanding comprises enabling the pressure exerting medium to be pumped through the pumping enabling element into the flexible member for expansion of the flexible member.

57. The method of claim 50, wherein the unheated blank is comprised of sheet metal, and wherein expanding comprises expanding the flexible member against the unheated sheet metal blank.

58. The method of claim 50, further comprising a plurality of form-shaping elements, and a plurality of flexible members, and wherein expanding comprises expanding the plurality of flexible members against the plurality of form-shaping elements.

59. The method of claim 50, wherein the article in which a shaped portion is to be bulge formed comprises a substantially large article, and wherein expanding further comprises forming the substantially large article.

60. The method of claim 50, wherein the article further comprises a finished part, and wherein expanding further comprises forming the finished part.

61. The method of claim 50, wherein the article is lightweight, and wherein expanding further comprises forming the lightweight article.

62. The method of claim 50, wherein the article comprises a complex shaped article which includes a plurality of shaped portions, and wherein expanding further comprises forming the complex shaped article.

63. The method of claim 53, wherein the bladder is comprised of rubber, and wherein expanding comprises expanding the rubber bladder.

64. The method of claim 53, wherein the bladder is comprised of polyurethane, and wherein expanding comprises expanding the polyurethane bladder.

65. The method of claim 56, wherein the pumping enabling element includes a tube, adapted to be connected to the flexible member, and wherein expanding comprises enabling the pressure-exerting medium to be pumped through the tube into the flexible member.

66. The method of claim 56, wherein the pressure-exerting medium comprises hydraulic fluid, and wherein expanding comprises enabling hydraulic fluid to be pumped through the pumping enabling means into the flexible member for expansion of the flexible member.

67. The system of claim 57, wherein the unheated sheet metal blank is comprised of aluminum, and wherein expanding comprises expanding the flexible member against the unheated aluminum blank.

68. The method of claim 59, wherein the article comprises an aircraft fuselage crown frame, and wherein expanding further comprises forming the aircraft fuselage crown frame.

69. The method of claim 59, wherein the article to be formed thereby further comprises a thin-walled article, and wherein expanding further comprises forming the thin-walled article.

70. The method of claim 59, wherein the article to be formed thereby further comprises a structural article, and wherein expanding further comprises forming the structural article.

71. The method of claim 59, wherein the unheated blank to be formed into the article is substantially large corresponding to the substantially large article, and wherein expanding further comprises exerting pressure on the substantially large unheated blank.

72. The method of claim 59, wherein the enclosing enabling element, the form-shaping element, and the flexible member are substantially large corresponding to the substantially large article, and wherein opening further comprises opening the substantially large enclosing enabling element and positioning the unheated blank relative to the substantially large form-shaping element, and expanding further comprises expanding the substantially large flexible member.

73. The method of claim 65, wherein the tube comprises a flexible tube, and expanding comprises enabling the pressure-exerting medium to be pumped through the flexible tube.

74. A method of bulge forming an unheated substantially flat blank which includes peripheral portions, by deforming the flat blank into an article which comprises a formed part, wherein the formed part includes a shaped portion, in a system which comprises deforming-enabling means for enabling deforming of the unheated blank so as to enable the shaped portions of the article to be formed thereagainst, including a complementary portion which is complementary in shape to the shape of the shaped portion of the article to be formed thereby, enclosing enabling means for enabling the deforming-enabling means to be enclosed therein, and for enabling the unheated blank to be positioned and enclosed therein without restricting deforming of the flat blank including the perhipheral portions thereof, a flexible member, adapted to be enclosed within the enclosing enabling means, to bulge within the enclosing enabling means upon the application of pressure to the flexible member, to exert pressure on the unheated blank adapted to be positioned in the enclosing enabling means, and to deform the unheated blank relative to the form-shaping element complementary portions to form the shaped portion of the article, and expansion enabling means for enabling expansion of the flexible member so as to exert pressure on the unheated blank and deform the unheated blank to form the shaped portion of the article against the deforming-enabling means, wherein the method comprises:

opening the enclosing enabling means and positioning the unheated blank therein relative to the form-shaping means;

closing the enclosing enabling means without restricting deforming of the flat blank including the peripheral portions thereof; and expanding the flexible member such that the flexible member bulges relative to the unheated blank and exerts pressure on the unheated blank against the deforming-enabling means so as to deform the unheated blank to form the shaped portion of the article.

75. A system for bulge forming an unheated substantially flat blank into an article which comprises a formed part and which includes a shaped portion, comprising:

a form-shaping element for enabling the shaped portions of the article to be formed thereagainst, including a complementary portion which is complementary in shape to the shape of the shaped portion of the article to be formed thereby;

an enclosing enabling element for enabling the form-shaping element to be enclosed therein, and for enabling the unheated blank to be positioned and enclosed therein, comprising a plurality of inter-engagable cage sections, adapted to be secured together to enable the article shaped portion to be formed therein, and to be separated to enable the unheated blank to be inserted therein or to enable removal of the article formed therein;

a flexible member, adapted to be enclosed within the enclosing enabling element, to bulge within the enclosing enabling element upon the application of pressure to the flexible member, to exert pressure on the unheated blank adapted to be positioned in the enclosing enabling element, and to bend the unheated blank relative to the form-shaping element complementary portion to form the shaped portion of the article; and an expansion enabling element for enabling expansion of the flexible member so as to exert pressure on the unheated blank and form the shaped portion of the article against the form-shaping element.

76. A system for bulge forming an unheated substantially flat blank into an article which comprises a formed part and which includes a shaped portion, comprising:

a form-shaping element for enabling the shaped portions of the article to be formed thereagainst, including a complementary portion which is complementary in shape to the shape of the shaped portion of the article to be formed thereby;

an enclosing enabling element for enabling the form-shaping element to be enclosed therein, and for enabling the unheated blank to be positioned and enclosed therein;

a flexible member, adapted to be enclosed within the enclosing enabling element, to bulge within the enclosing enabling element upon the application of pressure to the flexible member, to exert pressure on the unheated blank adapted to be positioned in the enclosing enabling element, and to bend the unheated blank relative to the form-shaping element complementary portion to form the shaped portion of the article;

an expansion enabling element for enabling expansion of the flexible member so as to exert pressure on the unheated blank and form the shaped portion of the article against the form-shaping element;

a plurality of form-shaping elements; and a plurality of flexible members.

77. A system for bulge forming an unheated substantially flat blank into an article which comprises a formed part and which includes a shaped portion, comprising:

form-shaping means for enabling the shaped portions of the article to be formed there against, including a complementary portion which is complementary in shape to the shape of the shaped portion of the article to be formed thereby;

enclosing enabling means for enabling the form-shaping means to be enclosed therein, and for enabling the unheated blank to be positioned and enclosed therein, comprising a plurality of inter-engagable cage sections, adapted to be secured together to enable the article shaped portion to be formed therein, and to be separated to enable the unheated blank to be inserted therein or to enable removal of the article formed therein;

a flexible member, adapted to be enclosed within the enclosing enabling means, to bulge within the enclosing enabling means upon the application of pressure to the flexible member, to exert pressure on the unheated blank adapted to be positioned in the enclosing enabling means, and to bend the unheated blank relative to the form-shaping element complementary portion to form the shaped portion of the article; and expansion enabling means for enabling expansion of the flexible member so as to exert pressure on the unheated blank and form the shaped portion of the article against the form-shaping element.

78. A system for bulge forming an unheated substantially flat blank into an article which comprises a formed part and which includes a shaped portion, comprising:

form-shaping means for enabling the shaped portions of the article to be formed there against, including a complementary portion which is complementary in shape to the shape of the shaped portion of the article to be formed thereby;

enclosing enabling means for enabling the form-shaping means to be enclosed therein, and for enabling the unheated blank to be positioned and enclosed therein;

a flexible member, adapted to be enclosed within the enclosing enabling means, to bulge within the enclosing enabling means upon the application of pressure to the flexible member, to exert pressure on the unheated blank adapted to be positioned in the enclosing enabling means, and to bend the unheated blank relative to the form-shaping element complementary portion to form the shaped portion of the article;

expansion enabling means for enabling expansion of the flexible member so as to exert pressure on the unheated blank and form the shaped portion of the article against the form-shaping element;

a plurality of form-shaping elements; and a plurality of flexible members.

79. A method of bulge forming an unheated substantially flat blank into an article which comprises a formed part and which includes a shaped portion, in a system which comprises a form-shaping element for enabling the shaped portions of the article to be formed thereagainst, including a complementary portion which is complementary in shape to the shape of the shaped portion of the article to be formed thereby, an enclosing enabling element for enabling the form-shaping element to be enclosed therein, and for enabling the unheated blank to be positioned and enclosed therein, comprising a plurality of inter-engagable cage sections, adapted to be secured together to enable the article shaped portion to be formed therein, and to be separated to enable the unheated blank to be inserted therein or to enable removal formed therein, a flexible member, adapted to be enclosed within the enclosing enabling element, to bulge within the enclosing enabling means upon the application of pressure to the flexible member, to exert pressure on the unheated blank adapted to be positioned in the enclosing enabling element, and to bend the unheated blank relative to the form-shaping element complementary portions to form the shaped portion of the article, and an expansion enabling element for enabling expansion of the flexible member so as to exert pressure on the unheated blank and form the shaped portion of the article against the form-shaping element, wherein the method comprises:

opening the enclosing enabling element and positioning the unheated blank therein relative to the form-shaping element;

closing the enclosing enabling element, comprising engaging together the sections of the enclosing enabling element; and expanding the flexible member such that the flexible member bulges relative to the unheated blank and exerts pressure on the unheated blank against the form-shaped element to form the shaped portion of the article.

* * * * *